US009731504B2

(12) United States Patent
Sekine et al.

(10) Patent No.: US 9,731,504 B2
(45) Date of Patent: Aug. 15, 2017

(54) LIQUID EJECTION HEAD AND LIQUID EJECTION APPARATUS

(71) Applicant: CANON KABUSHIKI KAISHA, Tokyo (JP)

(72) Inventors: Takayuki Sekine, Kawasaki (JP); Yoshiyuki Nakagawa, Kawasaki (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/089,979

(22) Filed: Apr. 4, 2016

(65) Prior Publication Data

US 2016/0297199 A1 Oct. 13, 2016

(30) Foreign Application Priority Data

Apr. 9, 2015 (JP) ..... 2015-080140

(51) Int. Cl.
*B41J 2/14* (2006.01)

(52) U.S. Cl.
CPC ..... *B41J 2/14129* (2013.01); *B41J 2/1408* (2013.01); *B41J 2/14088* (2013.01); *B41J 2202/08* (2013.01); *B41J 2202/12* (2013.01)

(58) Field of Classification Search
CPC .. B41J 2/14129; B41J 2/14088; B41J 2/1408; B41J 2202/08; B41J 2202/12
See application file for complete search history.

(56) References Cited

U.S. PATENT DOCUMENTS 7,585,053 B2 * 9/2009 Kim ..... B41J 2/14129 347/56
2007/0126804 A1 * 6/2007 Shim ..... B41J 2/1408 347/71
2010/0245486 A1 * 9/2010 Ishida ..... B41J 2/14129 347/63

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head having at least one energy generation element for generating heat to be used for ejecting a liquid includes an insulating layer which is provided in contact with a substrate and supports the energy generation element; at least one heat transmitting layer which is composed of a material having a higher thermal conductivity than that of a material of the insulating layer and which is provided, in the insulating layer, between the energy generation element and the substrate; and a heat transmitting member which thermally connects the at least one heat transmitting layer and the substrate, wherein the heat transmitting member is connected to an area, on the heat transmitting layer, excluding an area directly below the energy generation element in a position interposed between the energy generation element and the substrate.

15 Claims, 15 Drawing Sheets

LIQUID EJECTION HEAD AND LIQUID EJECTION APPARATUS

BACKGROUND OF THE INVENTION

Field of the Invention

The present invention relates to a liquid ejection head which ejects a liquid from an ejection port by utilizing heat generated by an energy generation element.

Description of the Related Art

Liquid ejection heads widely used in liquid ejection apparatuses are those configured such that an energy generation element is energized to heat a liquid to generate film boiling, which causes the liquid to bubble, and with the bubbling energy at this time, droplets are ejected from an ejection port. This type of liquid ejection head has a problem of efficiently releasing the heat generated by the energy generation element so as to suppress generation of bubbles due to the heat stored more than necessary.

U.S. Pat. No. 7,585,053 discloses a liquid ejection head configured such that the stored thermal energy is partially conducted to a heat transmitting layer being provided in an insulating layer and having a relatively high thermal conductivity, and quickly conducted to a substrate via a heat transmitting member provided between the heat transmitting layer and the substrate.

In the liquid ejection head disclosed in U.S. Pat. No. 7,585,053, heat generated by an energy generation element is conducted intensively to an area near the energy generation element on the substrate. This does not allow arrangement of a drive circuit, transistor, and the like in such an area on the substrate, and as a result, another space for arranging the drive circuit, transistor, and the like needs to be secured, which may cause the liquid ejection head itself to be enlarged.

SUMMARY OF THE INVENTION

In view of the above, an object of the present invention is to provide a liquid ejection head configured so as to avoid conduction of heat generated by an energy generation element intensively to a part on a substrate.

According to a first aspect of the present invention, there is provided a liquid ejection head including at least one energy generation element for generating heat to be used for ejecting a liquid, comprising: an insulating layer which is provided in contact with a substrate and supports the energy generation element; at least one heat transmitting layer which is composed of a material having a higher thermal conductivity than that of a material of the insulating layer and which is provided, in the insulating layer, between the energy generation element and the substrate; and a heat transmitting member which thermally connects the at least one heat transmitting layer and the substrate, wherein the heat transmitting member is connected to an area, on the heat transmitting layer, excluding an area directly below the energy generation element in a position interposed between the energy generation element and the substrate.

According to a second aspect of the present invention, there is provided a liquid ejection head comprising: a substrate; a heat transmitting layer provided above and along a surface of the substrate; an energy generation element which is provided above the heat transmitting layer and generates energy to be used for ejecting a liquid; and a heat transmitting member which thermally connects the heat transmitting layer and the substrate, wherein as viewed from a direction perpendicular to the surface of the substrate, the heat transmitting layer is provided in a position where the heat transmitting layer at least partially overlaps the energy generation element and the heat transmitting member is provided in a position where the heat transmitting member does not overlap the energy generation element.

According to a third aspect of the present invention, there is provided a liquid ejection head for ejecting a liquid, comprising; a substrate; a heat transmitting layer provided above and along a surface of the substrate; an energy generation element which is provided above the heat transmitting layer and generates energy to be used for ejecting a liquid; and a heat transmitting member which thermally connects the heat transmitting layer and the substrate, wherein as viewed from a direction perpendicular to the surface of the substrate, with respect to a first area which overlaps the energy generation element and a second area adjacent to the first area, the second area not overlapping the energy generation element, a density of the heat transmitting member provided in the first area is lower than that of the heat transmitting member provided in the second area.

According to a fourth aspect of the present invention, there is provided a liquid ejection apparatus including a liquid ejection head characterized in that the liquid ejection head is used to eject a liquid on a print medium to perform printing, the liquid ejection head comprising: an insulating layer which is provided in contact with a substrate and supports an energy generation element; at least one heat transmitting layer which is composed of a material having a higher thermal conductivity than that of a material of the insulating layer and is provided, in the insulating layer, between the energy generation element and the substrate; and a heat transmitting member which thermally connects the at least one heat transmitting layer and the substrate, wherein the heat transmitting member is connected to an area, on the heat transmitting layer, excluding an area directly below the energy generation element in a position interposed between the energy generation element and the substrate.

Further features of the present invention will become apparent from the following description of exemplary embodiments (with reference to the attached drawings).

DESCRIPTION OF THE EMBODIMENTS

With reference to the drawings, explanation will be given below of a liquid ejection head according to embodiments of the present invention. It should be noted that the embodiments described below are appropriate specific examples of the present invention, and thus are technically preferably limited in various ways. However, as long as the concept of the present invention is followed, embodiments according to the present invention are not limited to the embodiments described below.

In the embodiments of the present invention, a heat transmitting member provided in an insulating layer of a liquid ejection head is connected to a heat transmitting layer excluding an area, on the heat transmitting layer, near an energy generation element. This configuration avoids conduction of the heat generated by the energy generation element intensively to a part on a substrate to allow the heat to be dispersively conducted to the substrate. Accordingly, it becomes possible to secure a space for arranging a drive circuit, transistor, and the like, and as a result, downsizing of the liquid ejection head can be realized.

Figure 1:
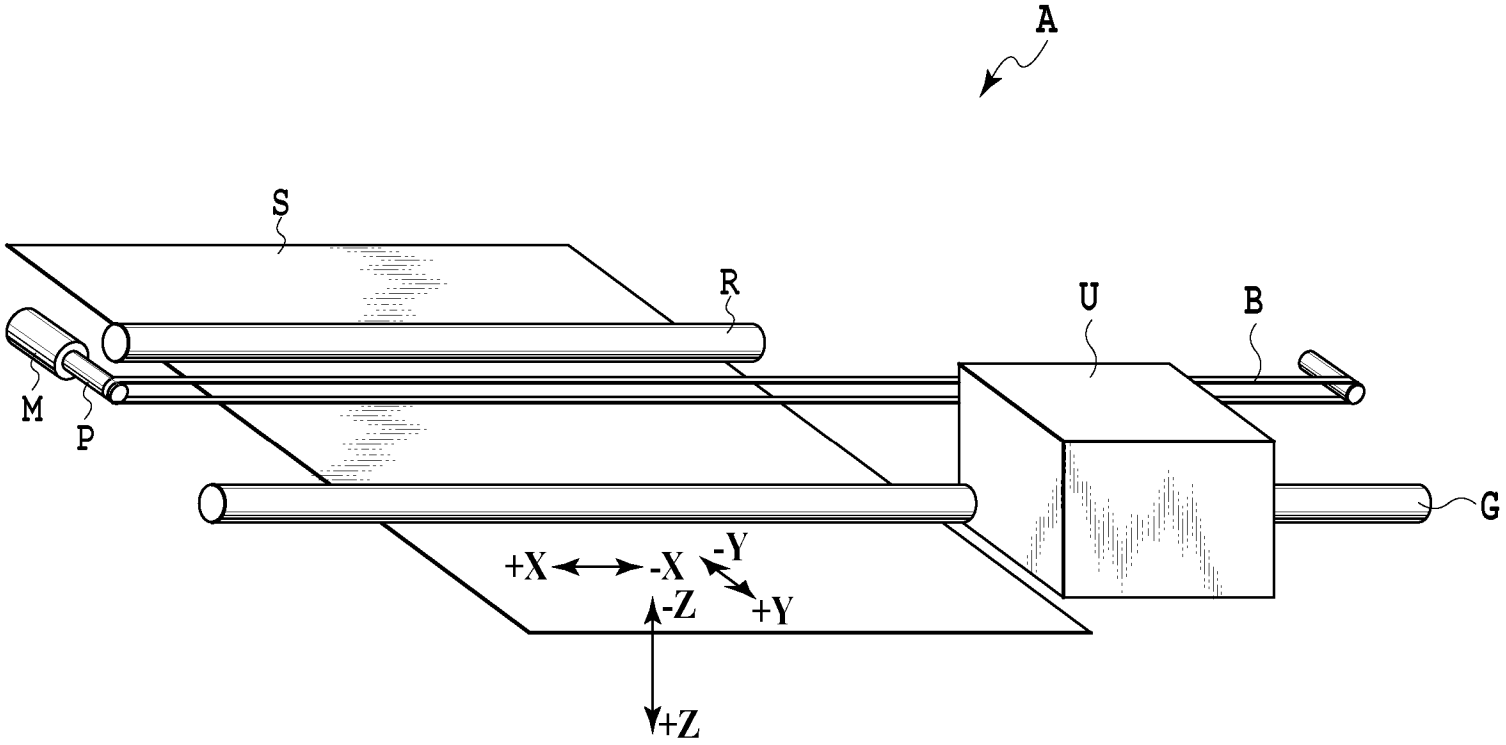
FIG. 1 is a schematic perspective view of a liquid ejection apparatus having a liquid ejection head according to an embodiment of the present invention.

FIG. 1 is a schematic perspective view of a liquid ejection apparatus A having a liquid ejection head according to an embodiment of the present invention. The liquid ejection apparatus A shown in FIG. 1 has a liquid ejection head unit U including a liquid ejection head in which a plurality of ejection ports are formed in an area facing against a print medium S. The liquid ejection head unit U may be configured, for example, such that the liquid ejection head and an ink tank are mounted on a carriage (not shown).

The liquid ejection head unit U is guided and supported, for example, by a guide shaft G, movably in a main scanning direction shown by +X, −X. The guide shaft G is arranged in such a manner as to extend along a width direction of the print medium S. The liquid ejection head unit U has a belt B attached thereto, the belt B being connected, for example, via a pulley P, to a drive motor M. A drive force of the drive motor M is conveyed through the belt B to the liquid ejection head unit U to move the liquid ejection head unit U along the guide shaft G. In the present specification, for convenience of explanation, directions in which the liquid ejection head unit U moves from and towards its home position are set to be a +X direction and a −X direction, respectively.

The print medium S is fed from a paper feed unit (not shown) and conveyed, by a conveying roller R, in a conveying direction, that is, a sub-scanning direction indicated by +Y. In the present specification, the conveying direction of the print medium S and a direction reverse to the conveying direction are set to be a +Y direction and a −Y direction, respectively.

The liquid ejection apparatus A carries out successively printing on the print medium S by repeating a printing operation in which a liquid such as ink is ejected in a direction indicated by +Z while the liquid ejection head unit U is moved in the main scanning direction and a conveying operation of conveying the print medium S. In the present specification, a direction in which the liquid is ejected from the liquid ejection head and a direction reverse thereto are set to be a +Z direction and a −Z direction, respectively. The direction indicated by +X, −X, the direction indicated by +Y, −Y, and the direction indicated by +Z, −Z are orthogonal to one another.

As stated above, the liquid ejection apparatus A is a so-called serial scan type liquid ejection apparatus in which an image is printed by the movement of the liquid ejection head in the main scanning direction and the conveyance of the print medium S in the sub-scanning direction. It should be noted that the present invention is not limited to this type and a so-called full-line type liquid ejection apparatus may be applicable, in which a liquid ejection head extending over a range corresponding to the entire width of the print medium S is used.

The configuration of the liquid ejection head according to the embodiment of the present invention will be described below, the explanation being made based on the directions X, Y, and Z indicated by arrows in FIG. 1. First, explanation will be given of a conventional liquid ejection head having a heat transmitting layer and a heat transmitting member which conduct, to a substrate, heat released from an energy generation element, as a comparative example of the embodiment according to the present invention. It should be noted that the liquid ejection head described below is an ink jet printing head, but the present invention is not limited to this type. Further, in the present specification, unless otherwise particularly mentioned, "up" indicates the +Z direction and "down" indicates the −Z direction.

COMPARATIVE EXAMPLE

Figure 2:
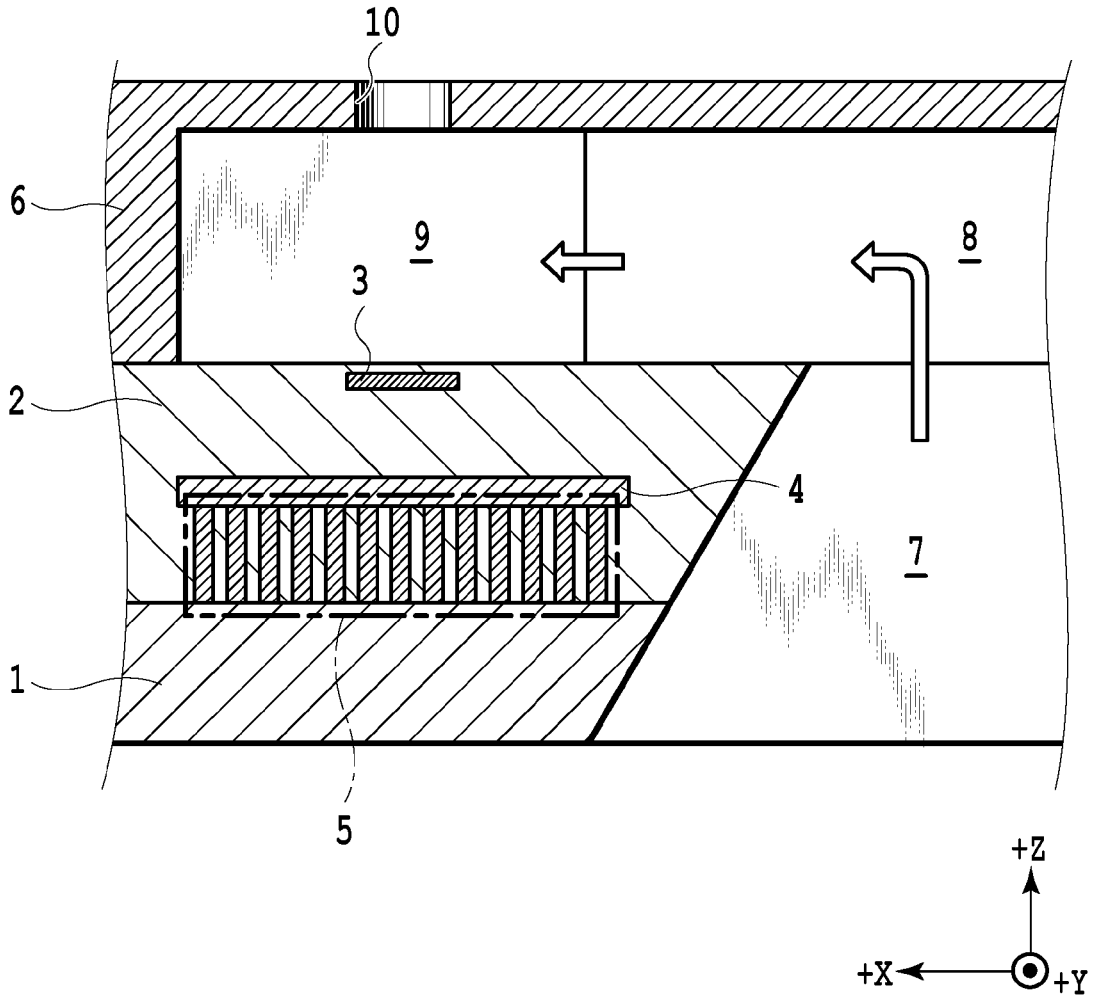
FIG. 2 is a cross-sectional view showing an example of a liquid ejection head according to a comparative example.

FIG. 2 is a cross-sectional view of an example of the liquid ejection head according to the comparative example. The liquid ejection head according to the comparative example has a substrate 1, an insulating layer 2 formed on the substrate 1, and an energy generation element 3 formed in the insulating layer 2. Further, the liquid ejection head according to the comparative example has a heat transmitting layer 4 which is formed in the insulating layer 2 and below the energy generation element 3, a plurality of vias 5 which thermally connect the heat transmitting layer 4 and the substrate 1, functioning as a heat transmitting member, and a flow path forming member 6 formed on the insulating layer 2. Furthermore, the liquid ejection head according to the comparative example includes, for example, a supply port 7, for introducing a liquid into a flow path 8, passing through the substrate 1 and the insulating layer 2, and the flow path 8 provided so as to communicate the supply port 7 with a pressure chamber 9. The liquid ejection head according to the comparative example is also configured to include the pressure chamber in communication with an ejection port 10 and the ejection port 10 which ejects the liquid to perform printing onto a print medium. The liquid flows from the supply port 7 through the flow path 8 into the pressure chamber 9 as indicated by an outline arrow shown in FIG. 2.

Figure 3:
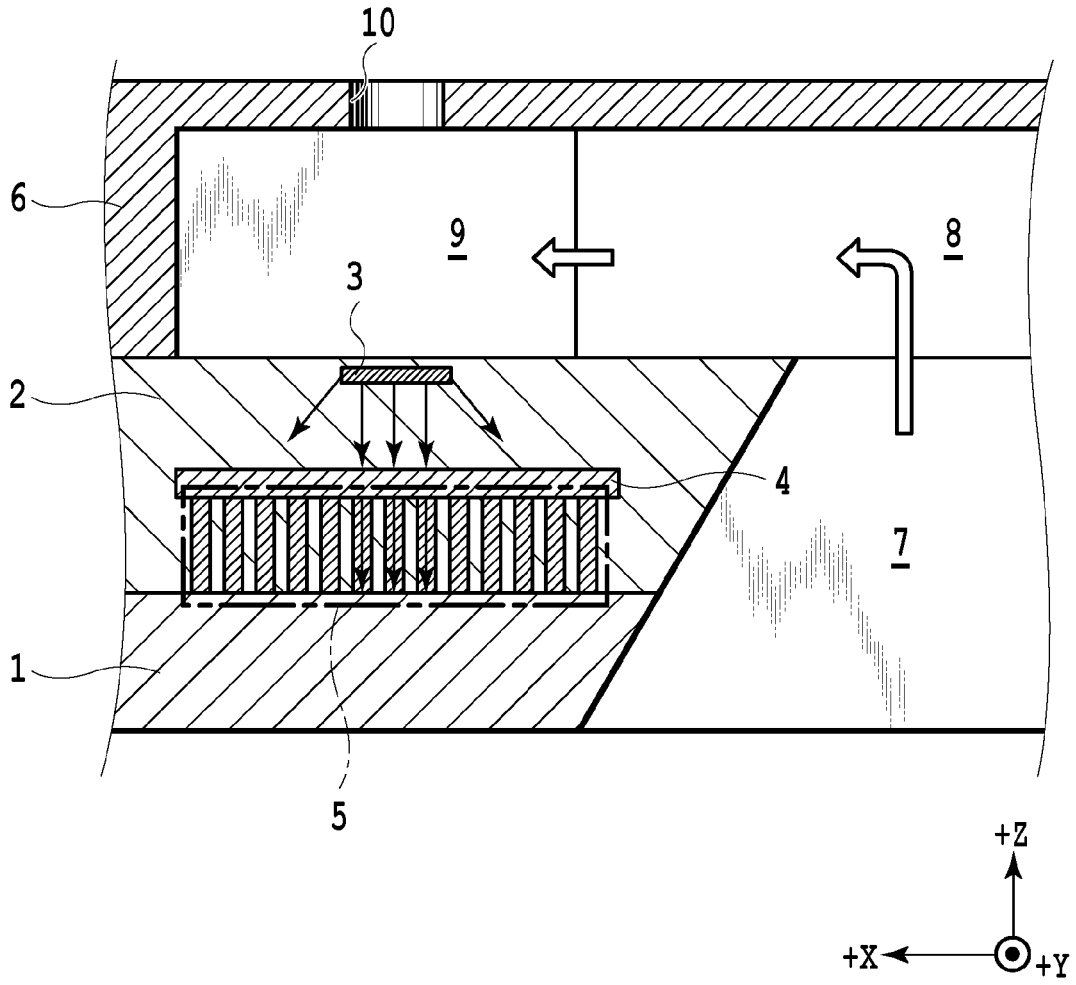
FIG. 3 is a view for explanation of diffusion of heat generated by an energy generation element in the liquid ejection head according to the comparative example.

FIG. 3 is a view for explanation of diffusion of heat generated by the energy generation element 3 in the liquid ejection head according to the comparative example, and the specific example will be described in the following (1) through (4):

(1) first, for liquid ejection, voltage application to the energy generation element 3 is initiated to cause the energy generation element 3 to start generating heat;

(2) the heat generated by the energy generation element 3 is imparted to the liquid adjacent to a surface on the side in the +Z direction of the energy generation element 3;

(3) meanwhile, the heat generated by the energy generation element 3 is diffused downwardly from the energy generation element 3 as indicated by black solid arrows to be conducted to the heat transmitting layer 4; and (4) the heat conducted to the heat transmitting layer 4 is conducted, as indicated by black solid arrows, intensively to an area, on a lower face of the heat transmitting layer 4, directly below the energy generation element 3 and thereafter flows intensively into an area, on the substrate 1, directly below the energy generation element 3. Here, the "lower face of the heat transmitting layer" refers to a face, of surfaces of the heat transmitting layer 4, opposing the substrate 1, and "directly below the energy generation element" refers to the −Z direction as viewed from the energy generation element. The "area, on a lower face of the heat transmitting layer, directly below the energy generation element" refers to an area (area directly below), on the lower face of the heat transmitting layer, in a position interposed between the energy generation element and the substrate. Further, "on the substrate" refers to an upper face of the substrate, that is, a face, of the surfaces of the substrate, opposing the energy generation element, and the "area, on the substrate, directly below the energy generation element" refers to an area, on the upper face of the substrate, in a position interposed between the energy generation element and a lower face of the substrate.

In this manner, the liquid ejection head according to the comparative example is configured such that the heat generated by the energy generation element 3 is released outside through the substrate 1, but the heat quickly flows intensively into the area, on the substrate 1, directly below the energy generation element 3. This creates a locally highly heated spot on the substrate 1, thereby causing a noise or defect in a case where a drive circuit, transistor, and the like are arranged in such a spot. Accordingly, the degree of freedom in arranging the drive circuit, transistor, and the like is reduced, thus making it difficult to downsize the liquid ejection head.

First Embodiment

Figure 4:
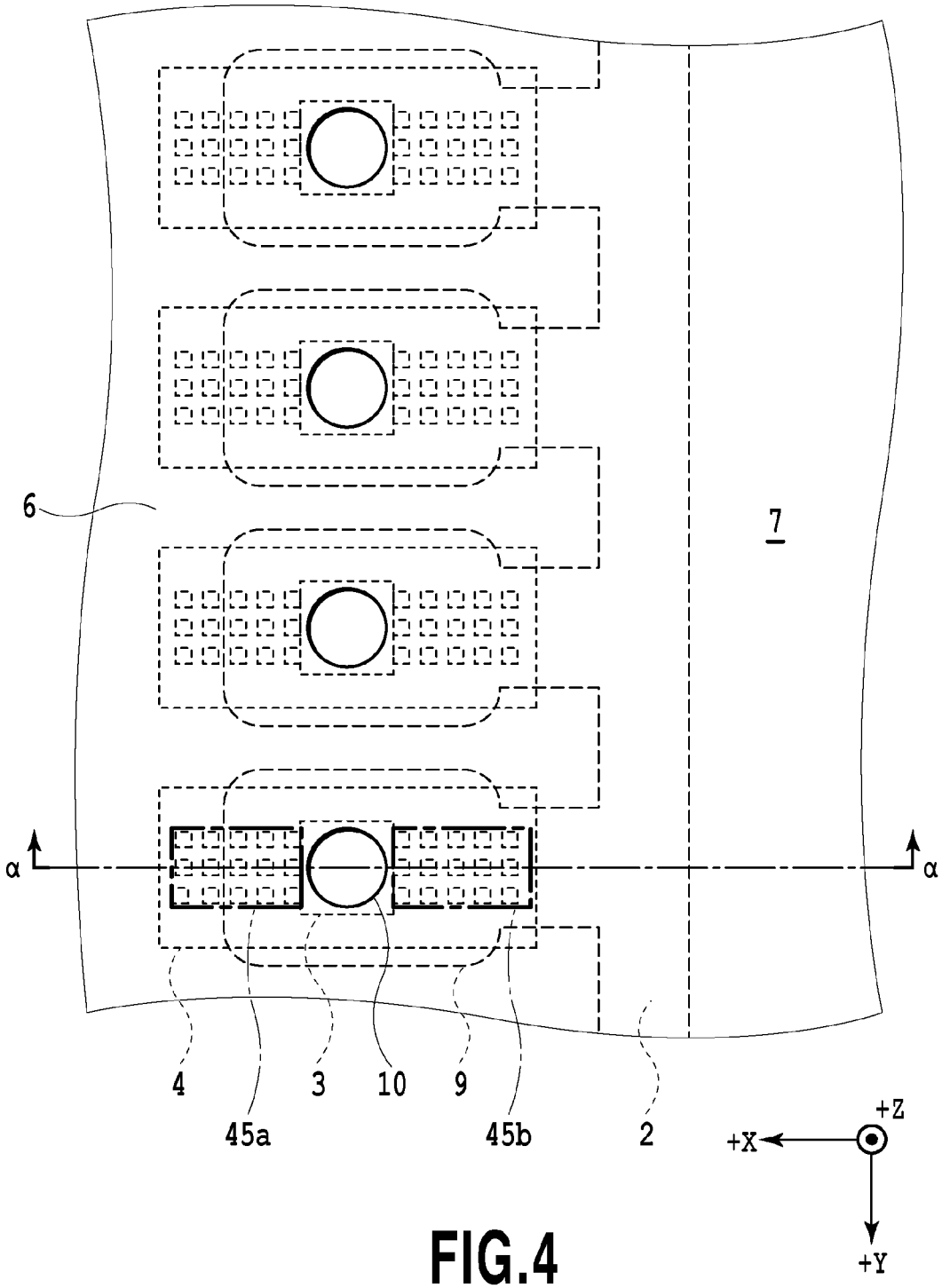
FIG. 4 is a plan view perspectively showing an example of a liquid ejection head according to a first embodiment.
Figure 5:
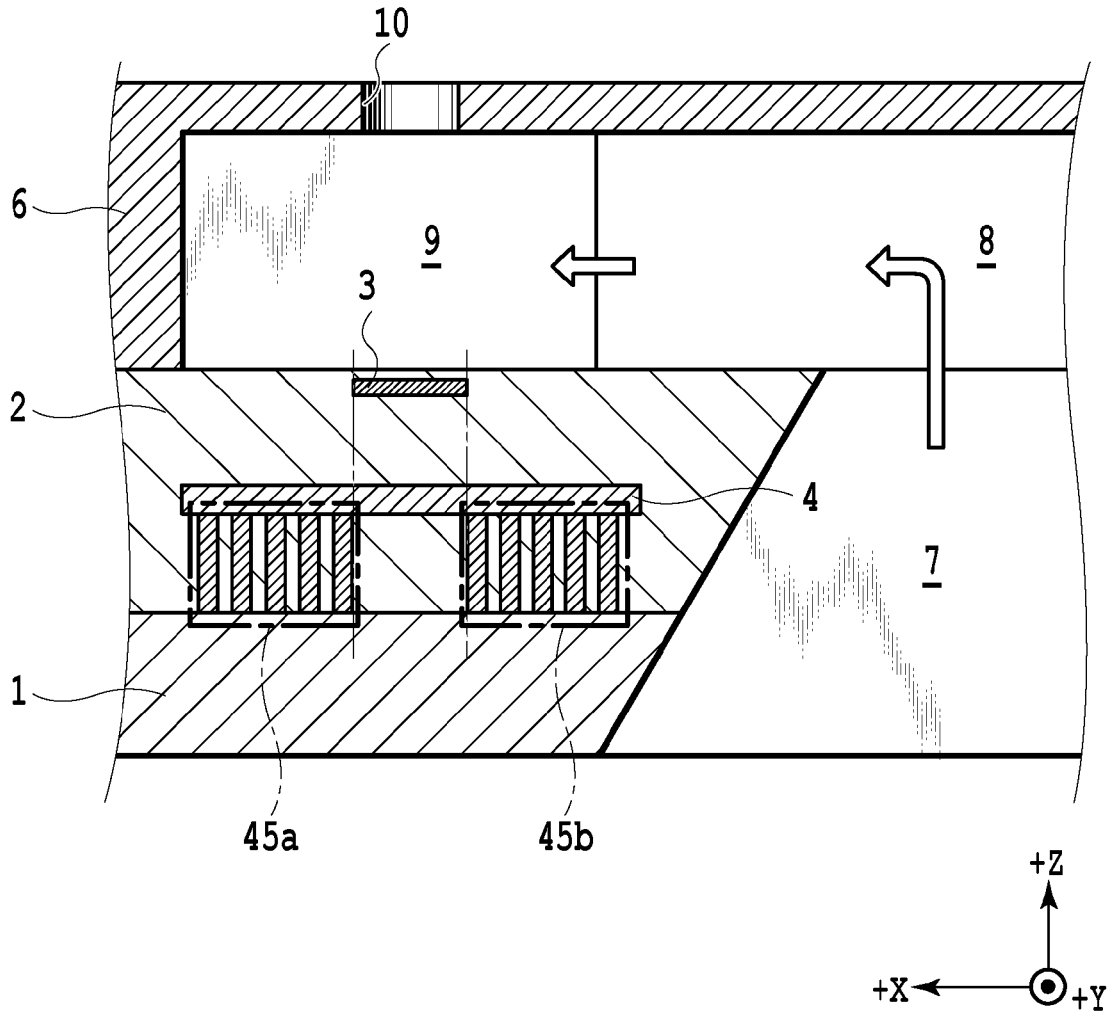
FIG. 5 is a cross-sectional view of the liquid ejection head taken along section line α-α shown in FIG. 4.

FIG. 4 is a plan view perspectively showing an example of a liquid ejection head according to the first embodiment of the present invention and FIG. 5 is a cross-sectional view of the liquid ejection head taken along section line α-α shown in FIG. 4. The liquid ejection head shown in FIG. 5 is configured such that the vias thermally connecting the lower face of the heat transmitting layer 4 and the substrate 1 are arranged differently from the liquid ejection head according to the comparative example shown in FIG. 2.

According to the present embodiment, as shown in FIG. 5, a plurality of vias 45*a* are provided, on the lower face of the heat transmitting layer 4, in an area excluding the area directly below the energy generation element 3 in the +X direction and a plurality of vias 45*b* are provided, on the lower face of the heat transmitting layer 4, in an area excluding the area directly below the energy generation element 3 in the −X direction. The vias form arrays of vias which are arranged in a predetermined interval in the X direction and a plurality of the arrays of vias are formed in the Y direction. Further, as shown in FIG. 4, as viewed from a direction perpendicular to the substrate, the vias are provided in an area (a first area) which does not overlap the energy generation element 3 and the heat transmitting layer 4 is provided in an area (a second area) which partially overlaps the energy generation element 3. Furthermore, the heat transmitting layer 4 is continuously provided in the first area and the second area adjacent to the first area. As shown in FIG. 5, the heat transmitting layer 4 and the energy generation element 3 are provided above the substrate 1 along the surface of the substrate 1 and above the heat transmitting layer 4, respectively.

Elements constituting the liquid ejection head according to the present embodiment which are denoted by the same reference numerals as those of the comparative example function similarly to those of the comparative example.

The liquid ejection head according to the present embodiment is provided with a plurality of liquid ejection ports. FIG. 4 shows only the configuration in which the liquid ejection ports 10 are provided in the +X direction relative to the supply port 7, but in the actual liquid ejection head, a side in the −X direction is similarly configured. In this case, the plurality of liquid ejection ports on the side in the −X direction may be arranged in the same positions in the Y direction as those in the plurality of ejection ports shown in the drawing or may be arranged in positions staggered by a half pitch in the Y direction relative to the plurality of ejection ports 10 in the drawing, that is, in a zigzag manner.

The substrate 1 may be composed of a material, for example, a silicon (Si) material, having a higher thermal conductivity than that of a material constituting the insulating layer 2. The insulating layer 2 is composed of, for example, silicon oxide, and has an insulating property to electrically isolate the substrate 1 from a wiring layer which will be described later. Further, the insulating layer 2 is provided so as to contact the substrate 1 and configured to support the energy generation element 3. The insulating layer 2 may also have a function of temporarily retaining the heat generated by the energy generation element 3 so as to secure continuous stable ejection. Another insulating layer composed of the same material as that of the insulating layer 2 or different material from that of the insulating layer 2 is provided so as to cover the energy generation element 3 provided in the insulating layer 2.

The energy generation element 3 includes, for example, an electrothermal transducer element such as a heating resistance element and is supplied with power from a drive circuit (not shown) via the wiring layer to generate heat to be used for ejecting the liquid. For the purpose of protecting the energy generation element 3 from cavitation occurring within the pressure chamber 9, a protection layer may be formed over the energy generation element 3.

The heat transmitting layer 4 is composed of a material having a higher thermal conductivity than that of the insulating layer 2, for example, aluminum (Al), tungsten (W), gold (Au), and silver (Ag) or a material including them, and a material having a property equivalent to the property thereof. The vias 45*a* and 45*b* may be in a hollow or solid columnar structure and composed of the same material as that of the heat transmitting layer 4. The via 45*b* is arranged near the supply port 7 through which the liquid flows and thus the heat conducted to the via 45*b* may be partially absorbed in the liquid flowing through the supply port 7. Accordingly, a heat flux of heat conducted onto the substrate through the via 45*b* is reduced, thereby enabling the increase in temperature on the substrate to be suppressed.

The flow path forming member 6 is formed on the insulating layer 2 for defining the pressure chamber 9 and the liquid ejection port 10. The supply port 7 is formed on the substrate 1 passing through the substrate 1 and the insulating layer 2 in such a manner as to fluidly communicate with the flow path 8. The supply port 7 is fluidly connected to the pressure chamber via the flow path 8. The flow path 8 is in communication with a plurality of pressure chambers, and continuously supplies each of the plurality of pressure chambers with the liquid supplied from, for example, an ink tank (not shown), via the supply port 7, so as to allow continuous ejection of the liquid out of the liquid ejection port 10 provided in each of the pressure chambers 9. The pressure chamber 9 stores the liquid caused to be ejected by the energy generation element 3.

Figure 6:
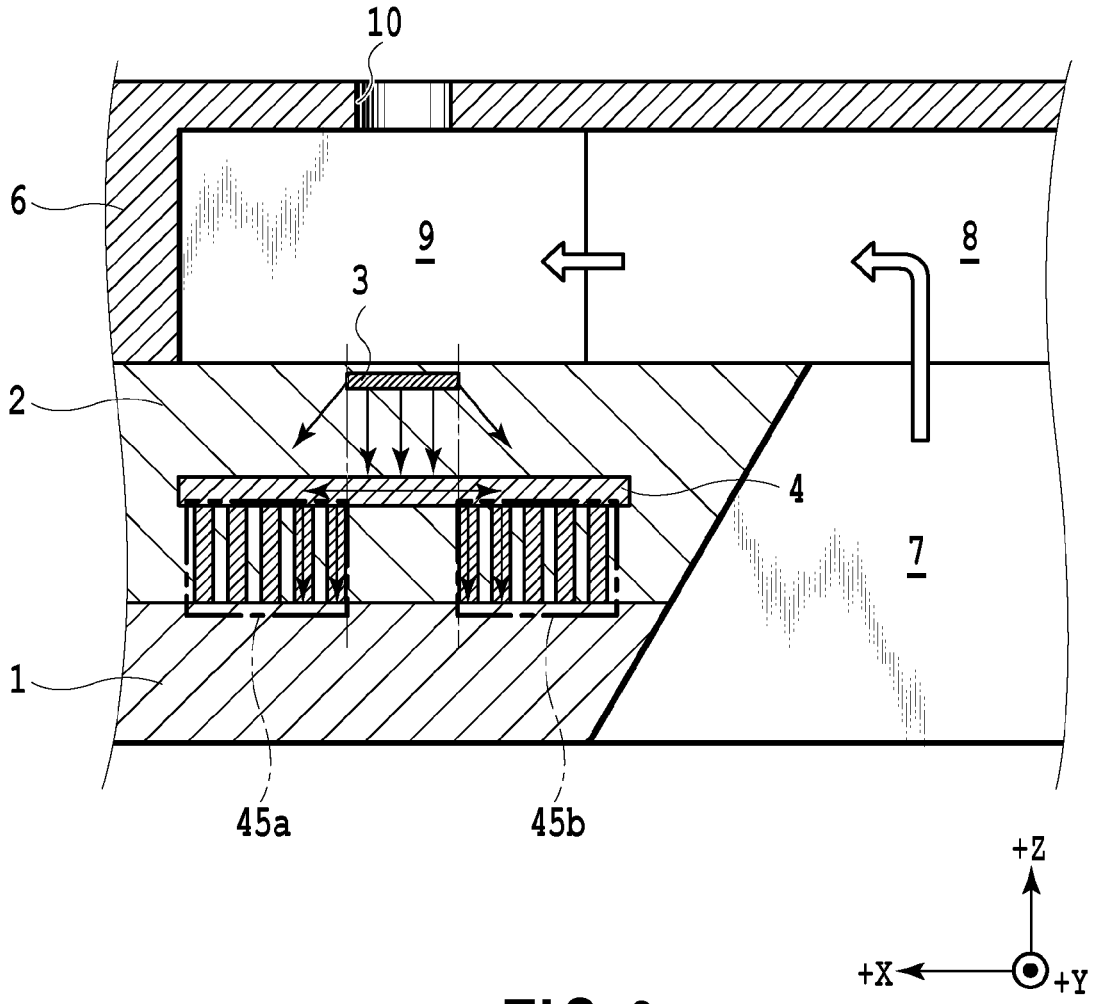
FIG. 6 is a view for explanation of diffusion of heat generated by an energy generation element in the liquid ejection head according to the first embodiment.

FIG. 6 is a view for explanation of diffusion of the heat generated by the energy generation element 3 in the liquid ejection head according to the first embodiment of the present invention. The specific example will be described below. Explanations in (1) through (3) regarding FIG. 3 also apply and thus will be omitted here.

(4) The heat conducted to the heat transmitting layer 4 is transmitted inside the heat transmitting layer 4, being actively diffused in a direction along the surface of the substrate 1, as indicated by the black solid arrow, and thereafter flows, through the vias 45*a* and 45*b*, onto the upper face of the substrate 1 excluding the area directly below the energy generation element 3.

In this manner, by connecting a plurality of vias to an area, on the lower face of the heat transmitting layer 4, excluding the area directly below the energy generation element 3, the flow of the heat generated by the energy generation element 3 intensively to the area, on the substrate 1, directly below the energy generation element 3, is avoided.

Recently, there has been a demand for image forming with high resolution at a high speed and liquid ejection heads having multiple liquid ejection ports highly densely arranged thereon have appeared. Meanwhile, large liquid ejection heads in a widely flat form are avoided considering the manufacturing cost of the liquid ejection head, while compact layered-type liquid ejection heads having wiring and circuits in a plurality of layers formed thereon are desired. In the compact layered-type structure, a drive circuit and transistor which supply, via a wiring layer, the energy generation element with power are arranged so as not to hinder the liquid ejection, for example, arranged in an area between the insulating layer 2 and the substrate 1.

In the liquid ejection head according to the comparative example, the heat generated by the energy generation element 3 immediately reaches, via the heat transmitting layer 4 and via 5, the area, on the substrate 1, directly below the energy generation element 3, and thus occasionally, the area directly below the energy generation element 3 is continuously kept at a high temperature.

In the present embodiment, the vias are not connected to the area, on the lower face of the heat transmitting layer 4, directly below the energy generation element 3, and thus the upper face, of the substrate 1, directly below the energy generation element 3 is not easily kept continuously at a high temperature, thereby allowing the arrangement of the drive circuit, transistor, and the like in the area directly below the energy generation element. Accordingly, the degree of freedom in arranging the drive circuit, transistor, and the like is improved to allow downsizing of the liquid ejection head.

Figure 7:
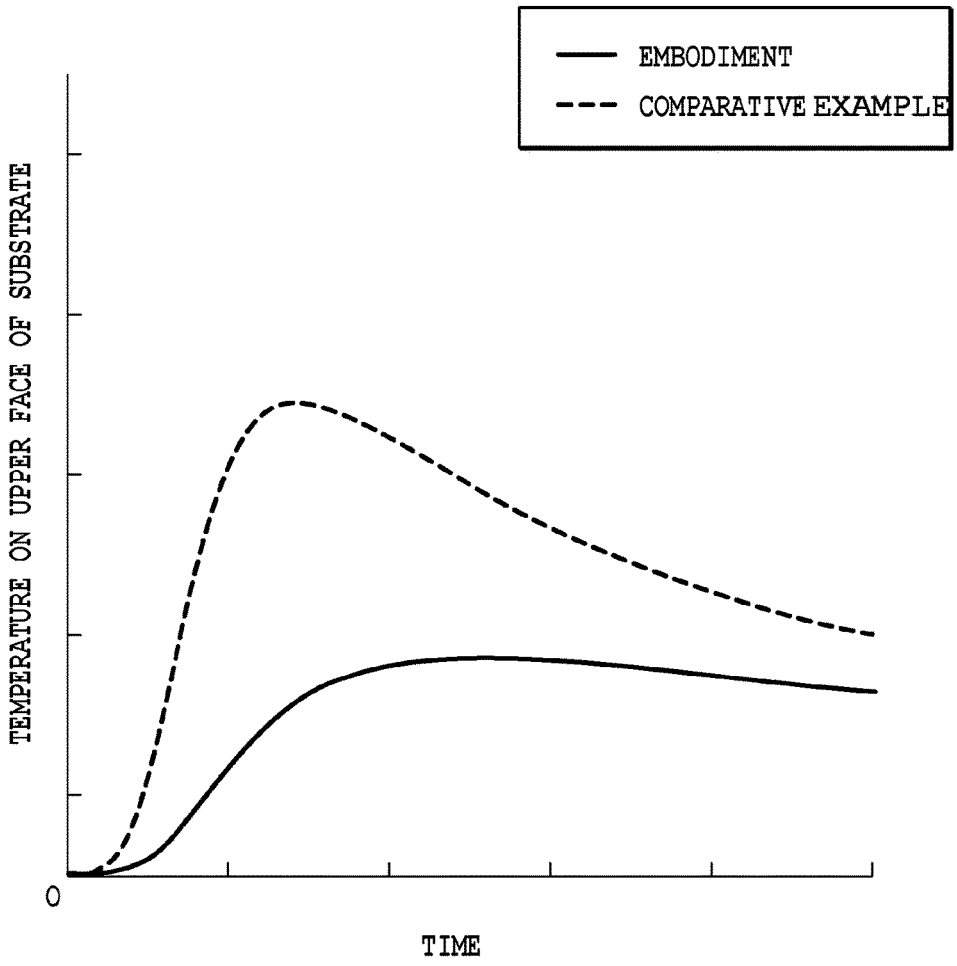
FIG. 7 is a graph for explanation of temporal change in maximum values of temperatures on upper faces of substrates in the liquid ejection heads according to the first embodiment and the comparative example.

FIG. 7 is a view for explanation of temporal change in maximum values of temperatures on the upper faces of the substrates in the liquid ejection heads according to the first embodiment and the comparative example of the present invention. In the graph shown in FIG. 7, the vertical axis represents the maximum value of the temperature on the upper face of the substrate 1 and the horizontal axis represents time. In FIG. 7, the time of starting voltage application to the energy generation element 3 is set to be an original point O, and the dotted line and the solid line represent graphs of the comparative example and the first embodiment, respectively. The graph shown in FIG. 7 is obtained, by using three-dimensional simulation, in a manner in which the temperature distribution on the upper face of the substrate 1 is prepared to extract the maximum values of the temperatures on the upper face of the substrate 1 and the extracted maximum values are plotted. The temperature distribution on the upper face of the substrate 1 is average temperature distribution on the upper face of the substrate 1 including both areas where the vias are provided and are not provided. It can be read from the graph shown in FIG. 7 that the maximum values of the temperatures on the upper face of the substrate 1 according to the first embodiment are nearly half as compared to those of the comparative example.

Figure 8:
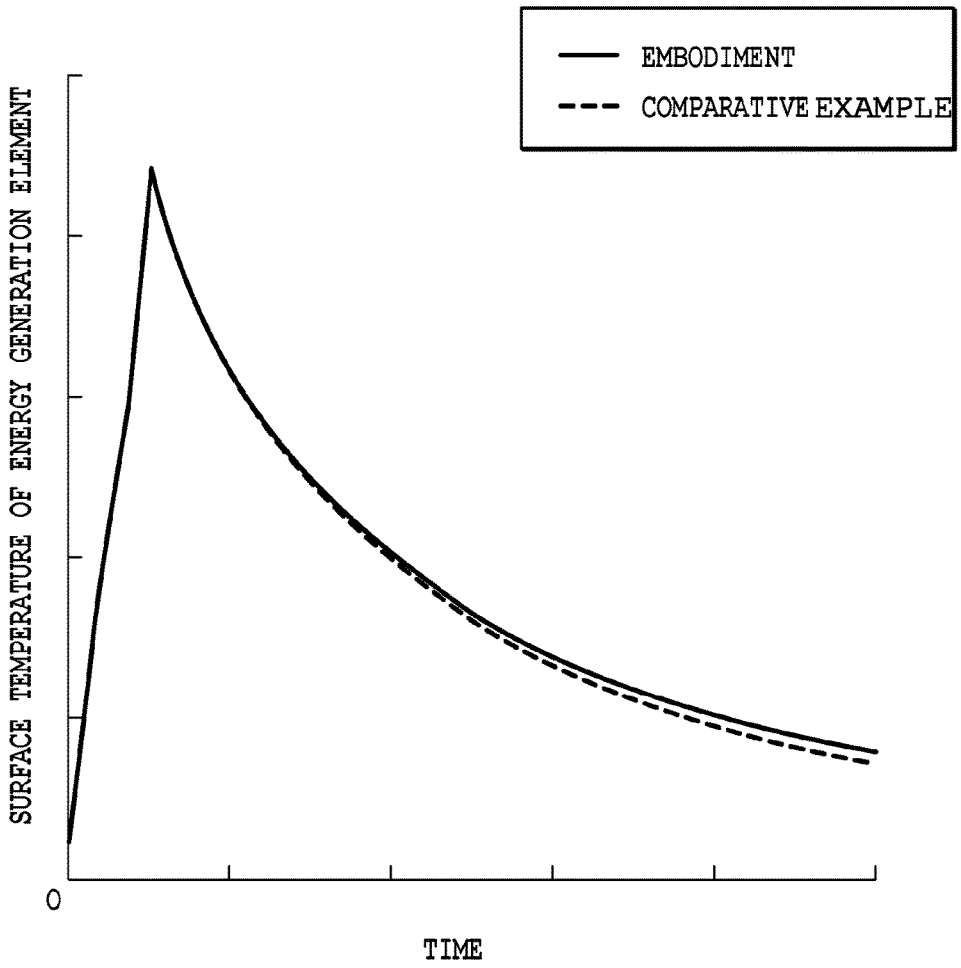
FIG. 8 is a graph for explanation of temporal change in surface temperatures of the energy generation elements in the liquid ejection heads according to the first embodiment and the comparative example.

FIG. 8 is a view for explanation of temporal change in surface temperatures of the energy generation elements of liquid ejection heads according to the first embodiment and the comparative example of the present invention. The temporal change in the surface temperatures of the energy generation elements 3 is also obtained by using three-dimensional simulation similarly to FIG. 7. The vertical axis represents the surface temperatures of the energy generation elements 3 and the horizontal axis represents time. In FIG. 8, the time of starting voltage application to the energy generation elements 3 is set to be an original point O, and the dotted line and the solid line represent graphs of the comparative example and the first embodiment, respectively. Here, the surface temperatures of the energy generation elements 3 are the temperatures on a face, of the surfaces of the energy generation element 3, which heats the liquid. As shown in FIG. 8, upon initiation of voltage application to the energy generation elements 3, the surface temperatures of the energy generation elements 3 begin to rise and upon stopping of the voltage application, release of the heat begins to cause the surface temperatures of the energy generation elements 3 to descend. It can be read from the graph shown in FIG. 8 that even if the vias are not connected to the area, on the lower face of the heat transmitting layer 4, directly below the energy generation element 3, the surface temperatures of the energy generation elements 3 of the comparative example and the first embodiment are not significantly different.

It can be understood from FIG. 7 and FIG. 8 that the configuration of the liquid ejection head according to the first embodiment can perform appropriate liquid ejection equivalent to that of the comparative example, while suppressing the increase in the maximum value of the temperature on the upper face of the substrate 1. Accordingly, the configuration of the liquid ejection head according to the first embodiment allows the arrangement of the drive circuit, transistor, and the like on the upper face of the substrate 1 including the area directly below the energy generation element 3, which improves the degree of freedom in the arrangement to allow downsizing of the liquid ejection head.

According to the present embodiment, a heat transmission path is provided in the insulating layer so as to avoid the flow of the heat intensively into a part on the substrate, thereby realizing appropriate diffusion of the heat generated by the energy generation element. Accordingly, the degree of freedom in arranging the drive circuit, transistor, and the like is improved to allow downsizing of the liquid ejection head.

Second Embodiment

Heat generated by the energy generation element is also diffused in a direction along the surface of the substrate and may affect heat generated by an adjacent energy generation element. In a liquid ejection head according to the second embodiment of the present invention, the vias are connected to an area, on the lower face of the heat transmitting layer, between two areas directly below the energy generation elements adjacent to each other. This realizes appropriate diffusion of the heat generated by the energy generation elements.

Figure 9:
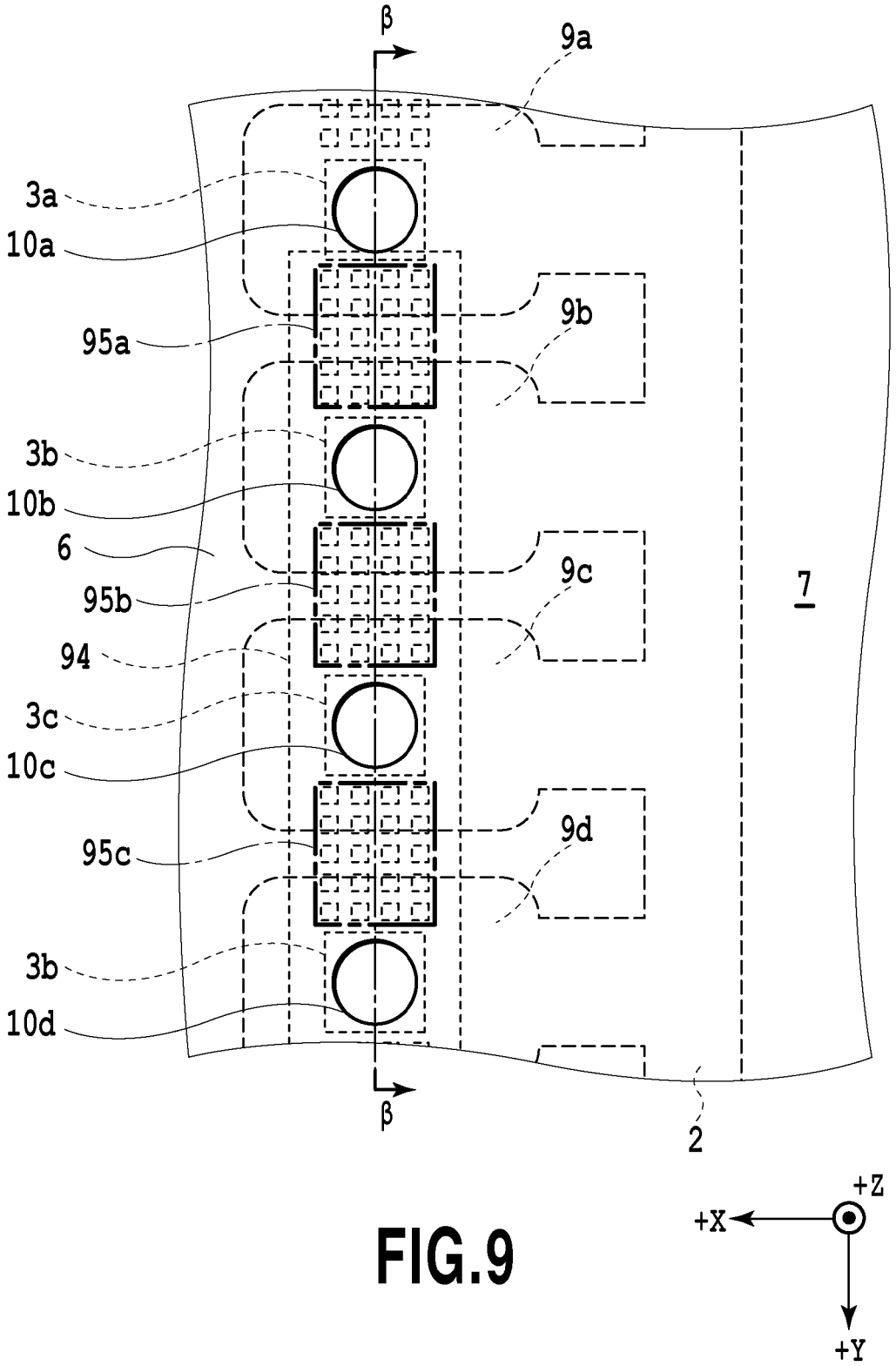
FIG. 9 is a plan view perspectively showing an example of a liquid ejection head according to a second embodiment.
Figure 10:
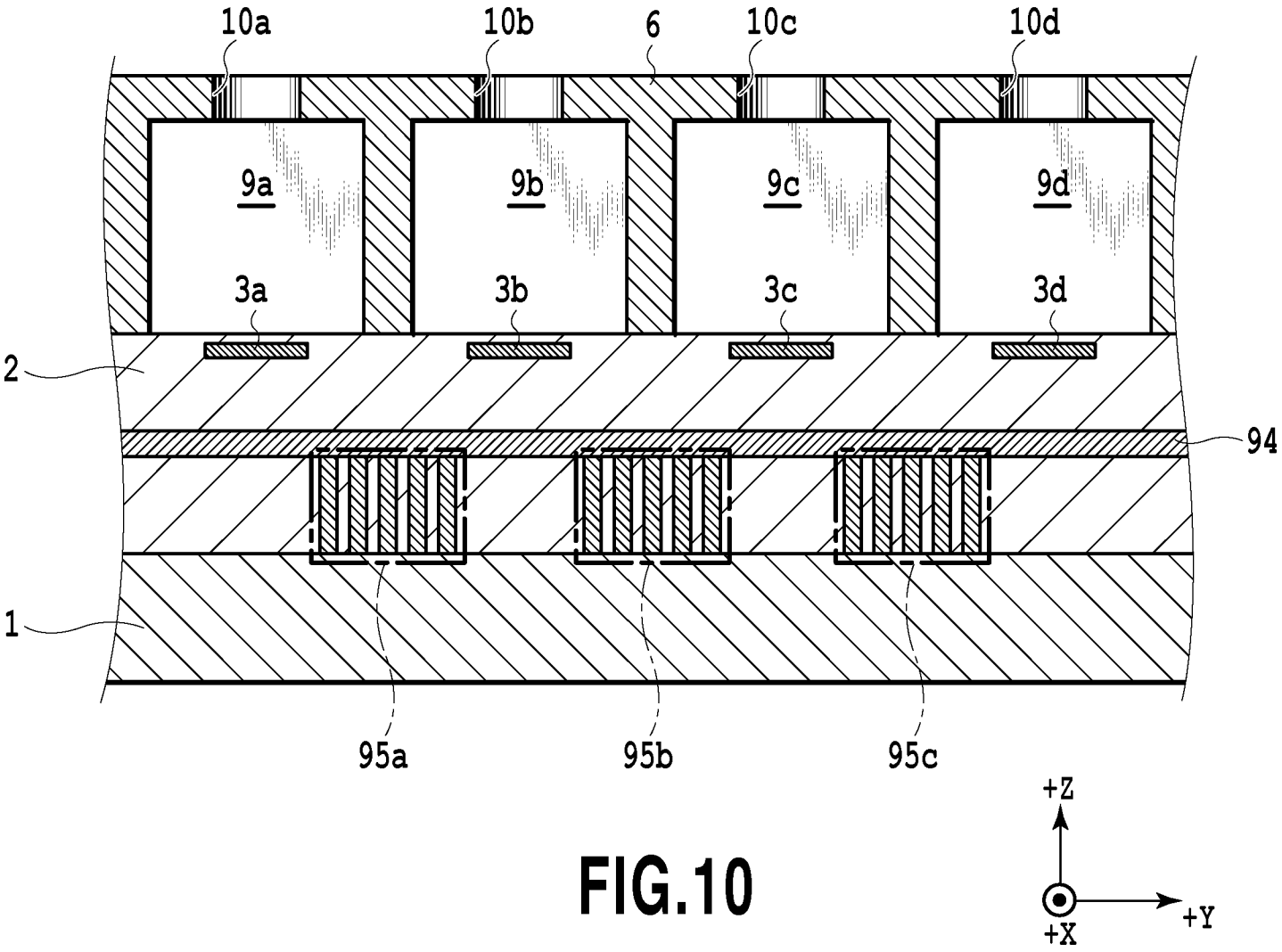
FIG. 10 is a cross-sectional view of the liquid ejection head taken along section line β-β shown in FIG. 9.

FIG. 9 is a plan view perspectively showing an example of the liquid ejection head according to the second embodiment of the present invention and FIG. 10 is a cross-sectional view of the liquid ejection head taken along section line β-β shown in FIG. 9. Elements constituting the liquid ejection head according to the present embodiment which are denoted by the same reference numerals as those of the first embodiment function similarly to those of the first embodiment. The liquid ejection head according to the present embodiment is configured such that the vias are connected to an area, on the lower face of the heat transmitting layer, between an area directly below the energy generation element and an area similarly directly below the adjacent energy generation element, excluding the areas directly below the energy generation elements.

The liquid ejection head according to the present embodiment is provided with energy generation elements 3*a*, 3*b*, 3*c*, and 3*d* and liquid ejection ports 10*a*, 10*b*, 10*c*, and 10*d* at positions facing thereto, respectively. The energy generation elements 3*a* and 3*b* are arranged adjacent to each other, and the same goes for the energy generation elements 3*b* and 3*c* and the energy generation elements 3*c* and 3*d*. A heat transmitting layer 94 is provided continuously along a direction in which a plurality of energy generation elements are arranged. A via 95*a* is connected to an area, on the lower face of the heat transmitting layer 94, between two areas directly below the energy generation elements 3*a* and 3*b*, a via 95*b* is connected to an area, on the lower face of the heat transmitting layer 94, between two areas directly below the energy generation elements 3*b* and 3*c*, and a via 95*c* is connected to an area, on the lower face of the heat transmitting layer 94, between two areas directly below the energy generation elements 3*c* and 3*d*. More specifically, the vias are connected to an area between areas directly below the plurality of energy generation elements.

The liquid supplied from the supply port 7 is provided to each of pressure chambers 9*a*, 9*b*, 9*c*, and 9*d* which are defined by the flow path forming member 6, and the liquid stored in each of the pressure chambers 9*a*, 9*b*, 9*c*, and 9*d* is ejected out of each of liquid ejection ports 10*a*, 10*b*, 10*c*, and 10*d*. For convenience of explanation, the present embodiment will be described by limiting the explanation to a region around the energy generation elements 3*b* and 3*c* adjacent to each other.

The heat generated by the energy generation element 3*b* reaches the heat transmitting layer 94 and is actively diffused in the direction along the surface of the substrate 1, and subsequently flows into the substrate 1 through the two vias 95*a* and 95*b* which are connected to the area, on the lower face of the heat transmitting layer 94, excluding the area directly below the energy generation element 3*b*. Similarly, the heat generated by the energy generation element 3*c* also flows into the substrate 1 via the heat transmitting layer 94 and through the two vias 95*b* and 95*c* which are connected to the area, on the lower face of the heat transmitting layer 94, excluding the area directly below the energy generation element 3*c*.

According to the present embodiment, the effect of the heat generated by the energy generation element on the heat generated by the adjacent energy generation element is suppressed. Also, according to the present embodiment, similarly to the first embodiment, the vias are not connected to the area, on the lower face of the heat transmitting layer, directly below the energy generation element, and thus the area, on the substrate, directly below the energy generation element, is not easily kept continuously at a high temperature. This allows the arrangement of the drive circuit, transistor, and the like in the area directly below the energy generation element. Accordingly, the degree of freedom in arranging the drive circuit, transistor, and the like is improved to allow downsizing of the liquid ejection head.

Figure 11:
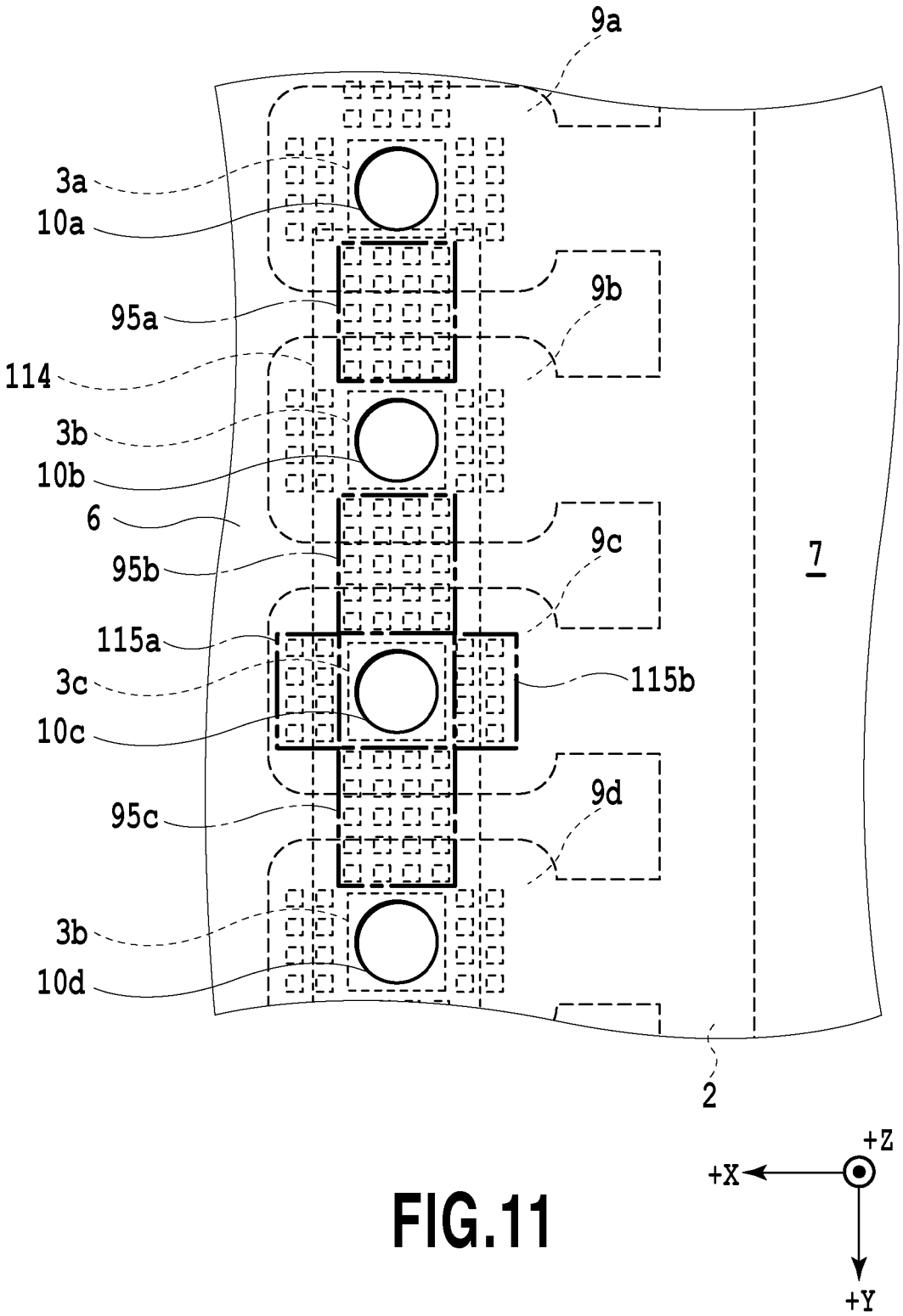
FIG. 11 is a plan view perspectively showing an example of a liquid ejection head according to a modification of the second embodiment.

FIG. 11 is a plan view perspectively showing an example of a liquid ejection head according to a modification of the second embodiment of the present invention. In the liquid ejection head according to the present modification, in addition to the vias in FIG. 9 and FIG. 10 described above, vias are further arranged in a +X direction and a −X direction relative to the area directly below the energy generation element. Specifically, for example, a via 115*a* and a via 115*b* are arranged in the +X direction and the −X direction, respectively, centered on the energy generation element 3*c*. As a result, the vias are arranged in such a manner as to surround all sides of each of the energy generation elements 3*a*, 3*b*, 3*c*, and 3*d*. The liquid ejection head according to the present modification shown in FIG. 11 is provided with a heat transmitting layer 114 thermally connectable to the vias 115*a* and 115*b* instead of the heat transmitting layer 94 of the liquid ejection head according to the second embodiment.

The heat generated by the energy generation element 3*c*, for example, reaches the heat transmitting layer 114 and is actively diffused within the heat transmitting layer 114 in the direction along the surface of the substrate 1, and subsequently the diffused heat flows into the substrate 1 through the vias 95*b*, 95*c*, 115*a*, and 115*b* which are connected to the area, on the lower face of the heat transmitting layer 114, excluding the area directly below the energy generation element.

According to the present modification, the effect of the heat generated by the energy generation element on the heat generated by the adjacent energy generation element is further suppressed as compared to the second embodiment. Further, according to the present modification, similarly to the second embodiment, the drive circuit, transistor, and the like can be arranged in the area, on the substrate, directly below the energy generation element and as a result, the degree of freedom in arranging the drive circuit, transistor, and the like is improved to allow downsizing of the liquid ejection head.

Third Embodiment

In the configuration of the first embodiment, in a case where the heat generated by the energy generation element 3 is not sufficiently released outside, appropriate diffusion of the heat generated by the energy generation element can be realized by increasing the number of the heat transmitting layers provided in the area directly below the energy generation element and changing the arrangement of the vias.

The heat transmitting layer provided in a liquid ejection head according to the third embodiment has a plurality of heat transmitting layers, including at least a first heat transmitting layer arranged along the surface of the substrate 1 and a second heat transmitting layer arranged in an area between the first heat transmitting layer and the energy generation element, along the first heat transmitting layer. A plurality of vias are connected to an area, on a lower face of the first heat transmitting layer, excluding the area directly below the energy generation element.

Figure 12:
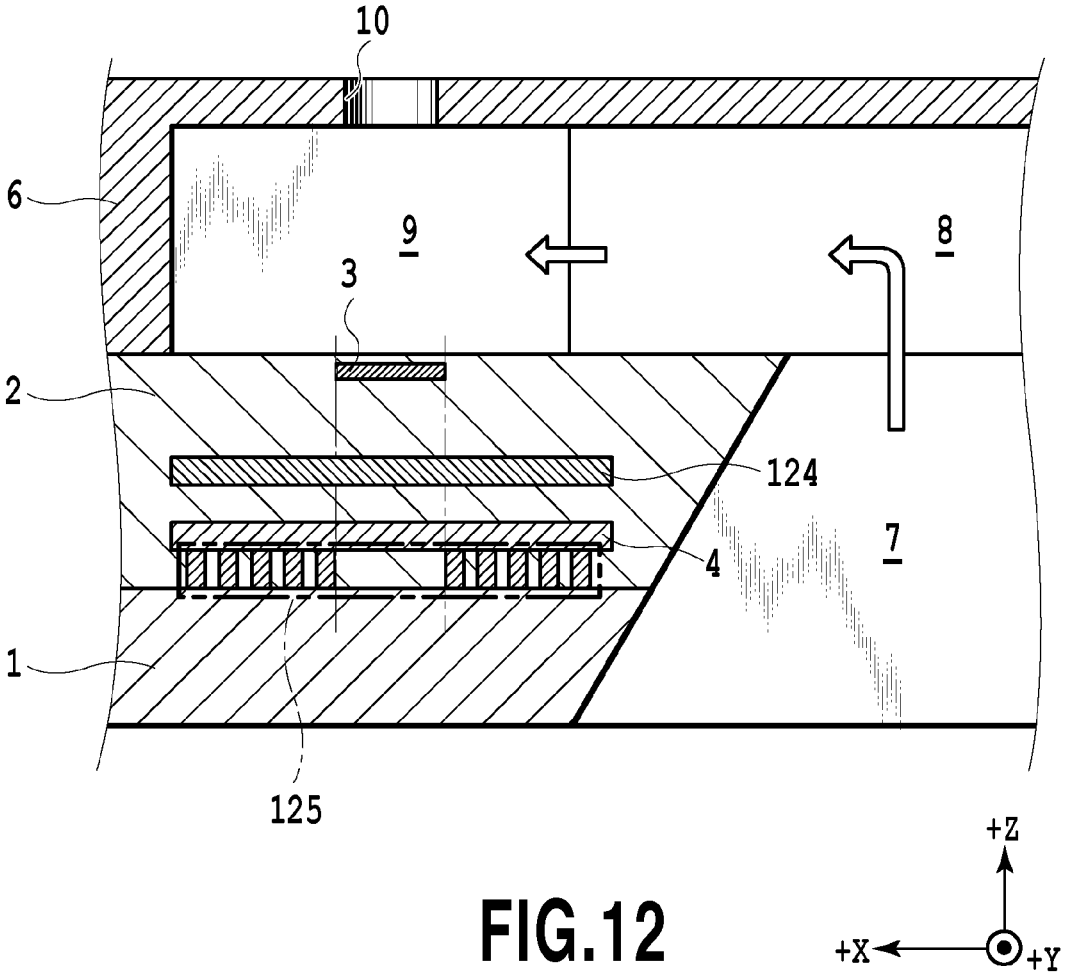
FIG. 12 is a cross-sectional view of an example of a liquid ejection head according to a third embodiment.

FIG. 12 is a cross-sectional view of an example of the liquid ejection head according to the third embodiment of the present invention. The liquid ejection head shown in FIG. 12 further has a second heat transmitting layer 124 provided between the energy generation element 3 and the heat transmitting layer 4 (called the first heat transmitting layer in the present embodiment and the modification) which are shown in FIG. 5 and a via 125 provided between the first heat transmitting layer 4 and the substrate 1. Elements constituting the liquid ejection head shown in FIG. 12 which are denoted by the same reference numerals as those of the first embodiment function similarly to those of the first embodiment.

The heat generated by the energy generation element 3 reaches the second heat transmitting layer 124 and is actively diffused within the second heat transmitting layer 124 in the direction along the surface of the substrate 1, and is subsequently diffused downwardly from the second heat transmitting layer 124. Then, part of the diffused heat reaches the first heat transmitting layer below the second heat transmitting layer 124 and is actively diffused within the first heat transmitting layer 4 in the direction along the surface of the substrate 1. The diffused heat then passes through the via 125 connected to an area, on the lower face of the first heat transmitting layer 4, excluding the area directly below the energy generation element 3, to flow into the substrate 1 to be released outside. Accordingly, the liquid ejection head according to the present embodiment is configured such that the heat flux of the heat generated by the energy generation element 3 can be reduced more as compared to the first embodiment.

According to the present embodiment, the drive circuit, transistor, and the like can be arranged in the area, on the substrate, directly below the energy generation element. This improves the degree of freedom in arranging the drive circuit, transistor, and the like to allow downsizing of the liquid ejection head.

Figure 13:
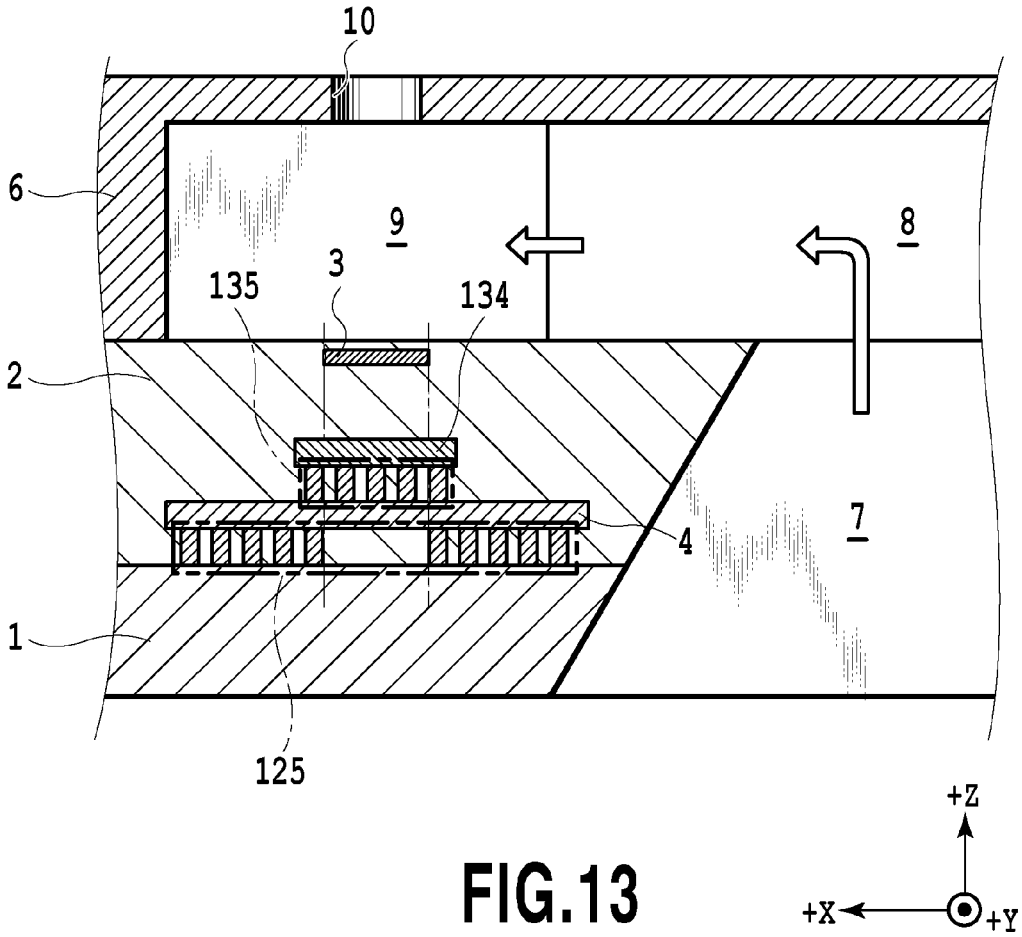
FIG. 13 is a cross-sectional view of an example of a liquid ejection head according to a modification of the third embodiment.

FIG. 13 is a cross-sectional view of an example of a liquid ejection head according to a modification of the third embodiment of the present invention. The liquid ejection head shown in FIG. 13 further has a second heat transmitting layer 134 having a reduced width in the direction +X, −X instead of the second heat transmitting layer 124 of the liquid ejection head shown in FIG. 12 and via 135, which is an interposing member, between the second heat transmitting layer 134 and the first heat transmitting layer 4. The via 135, the interposing member, may adopt a material having the same property as that of the via 125 which is a heat transmitting member. The via 135 provided in the liquid ejection head according to the present modification is connected to the area, on the lower face of the second heat transmitting layer 124, including the area directly below the energy generation element 3. Elements constituting the liquid ejection head shown in FIG. 12 which are denoted by the same reference numerals as those of the first embodiment function similarly to those of the first embodiment.

In the present modification, the second heat transmitting layer 134 has a reduced width as compared to the second heat transmitting layer 124 in the third embodiment, and thus the heat generated by the energy generation element 3 passes through the second heat transmitting layer 134 and then the via 135 to quickly reach the first heat transmitting layer 4. Further, the heat which has reached the first heat transmitting layer 4 is actively diffused within the heat transmitting layer 4 in a direction along the surface of the substrate 1 and subsequently passes through the via 125 connected to the area, on the lower face of the first heat transmitting layer 4, excluding the area directly below the energy generation element 3 to flow into the substrate 1. Accordingly, the liquid ejection head according to the present modification is configured such that the heat generated by the energy generation element 3 is more quickly released outside as compared to the third embodiment.

According to the present modification, similarly to the third embodiment, the drive circuit, transistor, and the like can be arranged in the area, on the substrate, directly below the energy generation element. This improves the degree of freedom in arranging the drive circuit, transistor, and the like to allow downsizing of the liquid ejection head.

Fourth Embodiment

In the configurations of the liquid ejection heads according to the first through third embodiments, there may be a case where water in the liquid evaporates through an ejection port which does not eject the liquid for a long period of time, resulting in thickening of the liquid inside the ejection port. In such a case, the ejection port may not be able to properly eject the liquid afterwards. A liquid ejection head according to the fourth embodiment is configured such that the liquid flowing into the pressure chamber is circulated so as to avoid the thickening of the liquid to be ejected as much as possible. Similarly to the first through third embodiments, the liquid ejection head according to the present embodiment is provided with the heat transmitting layer and vias in the insulating layer so as to secure appropriate diffusion of the heat generated by the energy generation element.

Further, in the liquid ejection head according to the present embodiment, the liquid is circulated in a side portion of the substrate 1, thereby making it possible to reduce the heat flux flowing into the substrate 1.

Figure 14:
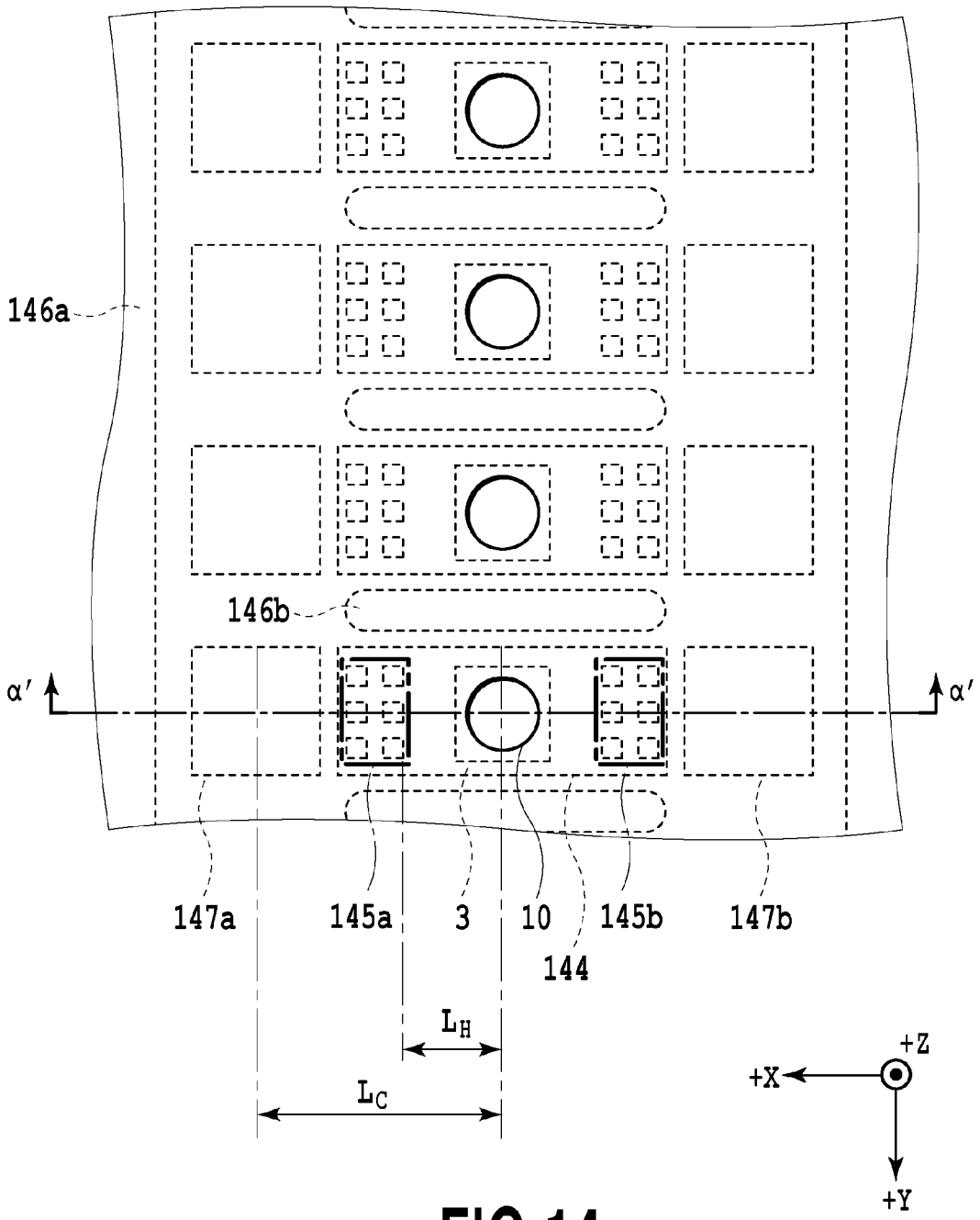
FIG. 14 is a plan view perspectively showing an example of a liquid ejection head according to a fourth embodiment.
Figure 15:
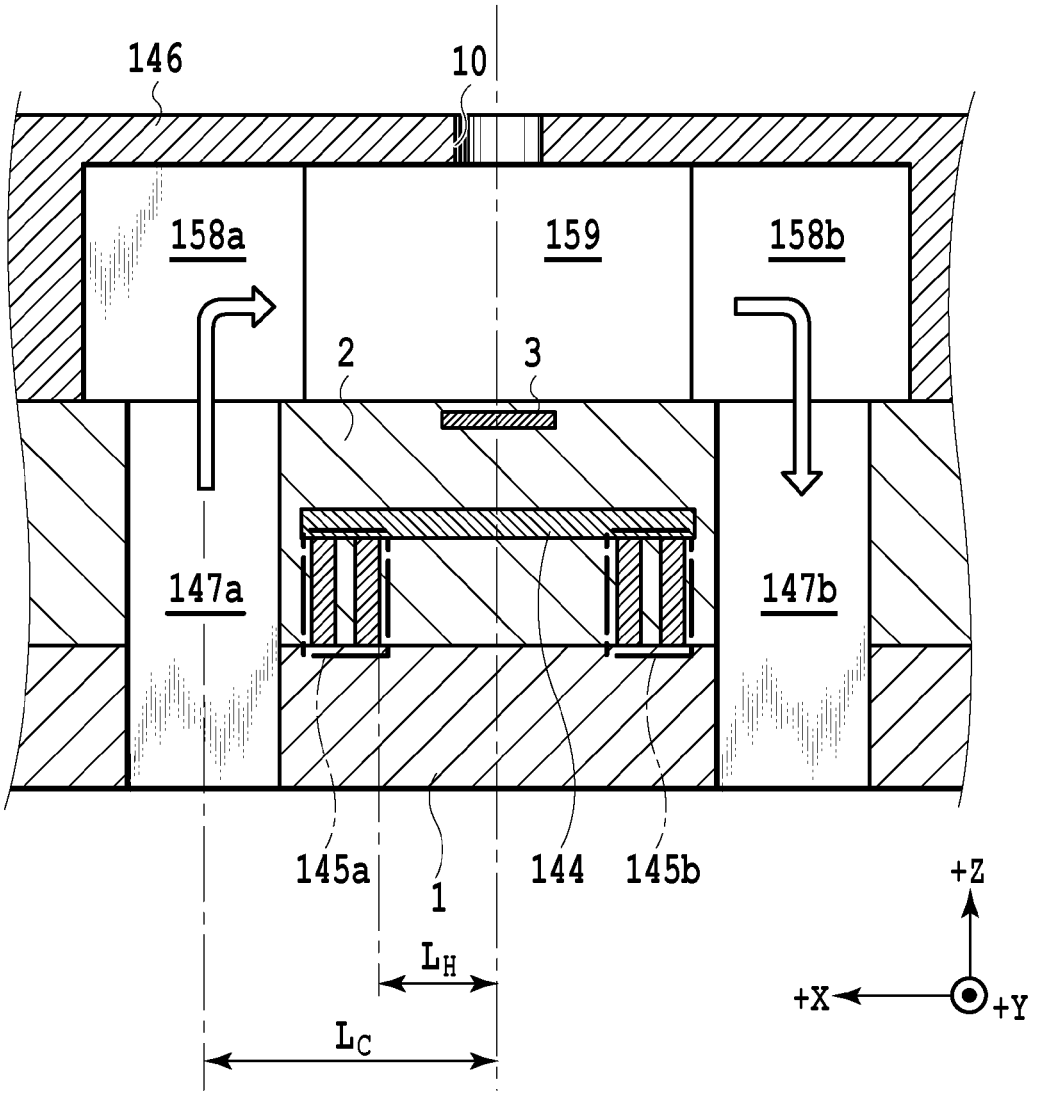
FIG. 15 is a cross-sectional view of the liquid ejection head taken along section line α'-α' shown in FIG. 14.

FIG. 14 is a plan view perspectively showing an example of the liquid ejection head according to the fourth embodiment of the present invention. FIG. 15 is a cross-sectional view of the liquid ejection head taken along section line α'-α' shown in FIG. 14. Elements constituting the liquid ejection head according to the present embodiment which are denoted by the same reference numerals as those of the first embodiment function similarly to those of the first embodiment.

The liquid ejection head according to the present embodiment has, for one ejection port, a pair of a first supply port 147*a*, which is a liquid supplying path, and a second supply port 147*b*, which is a liquid discharging path, which correspond to each other. For example, the liquid supplied to a pressure chamber 159 from the first supply port 147 through a flow path 158*a* is discharged, through a second flow path 158*b*, to the second supply port 147*b*, to be circulated. Then, the liquid under circulation is heated by the energy generation element 3 to generate film boiling, thereby ejecting the liquid out of the ejection port 10.

A heat transmitting layer 144 and the substrate 1 of the liquid ejection head according to the present embodiment are thermally connected to each other by means of vias 145*a* and 145*b*. The vias 145*a* and 145*b* are connected to the area, on a lower face of the heat transmitting layer 144, excluding the area directly below the energy generation element 3, and are arranged at a certain distance away from the area directly below the energy generation element 3 on the lower face of the heat transmitting layer 144, as compared to the above-described first through third embodiments. In the present embodiment, in a planar direction of the heat transmitting layer 144, the distance from the center (the center of gravity) of the energy generation element 3 to the via 145*a* is set to be $L_H$ and the distance from the center of the energy generation element 3 to the center (the center of gravity) of an opening of the first supply port 147*a* is set to be $L_C$. In the present embodiment, the distance $L_H$ is about half the distance $L_C$. It should be noted that the distance $L_H$ is preferably longer than the half of the distance $L_C$. That is, the via 145*a* is preferably connected to an area, on the lower face of the heat transmitting layer 144, where the distance $L_H$ is longer than the half of the distance $L_C$ in the planar direction of the heat transmitting layer 144.

Moreover, the via 145*a* and the via 145*b* are arranged adjacent to the first supply port 147*a* and the second supply port 147*b*, respectively, so as to allow the vias to be cooled with the liquid under circulation.

The heat generated by the energy generation element 3 reaches the heat transmitting layer 144 and is actively diffused within the heat transmitting layer 144 in the direction along the surface of the substrate 1. The diffused heat then passes through the vias 145*a* and 145*b* which are connected to the area, on the lower face of the first heat transmitting layer 144, excluding the area directly below the energy generation element 3 to flow into the substrate 1 to be released outside.

In the present embodiment, the heat conducted through the via 145*a* is absorbed in the liquid circulating within the first supply port 147*a* and the heat conducted through the via 145*b* is absorbed in the liquid circulating within the second supply port 147*b*, and accordingly, the heat flux flowing into the substrate 1 can be reduced.

According to the present embodiment, the increase in the temperature on the upper face of the substrate 1 can be suppressed. This improves the degree of freedom in arranging the drive circuit, transistor, and the like to allow downsizing of the liquid ejection head.

<Others>

The liquid ejection heads according to the first through third embodiments or the modifications thereof adopt a side-shooter print head which ejects a liquid in a direction substantially perpendicular to the substrate, but are not limited to this. For example, an edge-shooter print head which ejects a liquid in a direction substantially parallel to the substrate may be adopted.

The vias provided in the liquid ejection heads according to the first through fourth embodiments or the modifications thereof are in a solid or hollow columnar structure extending in a direction crossing the surface of the substrate, but are not limited to this structure. For example, the structure may be in a plate-like shape.

The liquid ejection heads according to the first through fourth embodiments or the modifications thereof do not include a circuit for supplying the energy generation element with power, but are not limited to this configuration. The circuit may be arranged on either an upper face or a lower face of the substrate, for example, may be incorporated into an area, on the surface of the substrate, opposing the energy generation element or may be provided so as to contact the lower face of the substrate.

In the above-described embodiments, the explanation was given of an aspect in which the vias thermally connected to the substrate are not provided directly below the energy generation element, as viewed from a direction perpendicular to the substrate. The above aspect in which the vias are not provided at all directly below the energy generation element is preferable in terms of heat, but a few vias may be provided in the area directly below the energy generation element. For example, if vias have a lower density (an area in which the via and the substrate contact) than vias provided in an area other than the area directly below the energy generation element, the vias having a lower density may be provided directly below the energy generation element. This allows the arrangement of a drive circuit, transistor, and the like in addition to the vias in the area directly below the energy generation element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-080140, filed Apr. 9, 2015, which is hereby incorporated by reference herein in its entirety.

What is claimed is:

1. A liquid ejection head including at least one energy generation element for generating heat to be used for ejecting a liquid, comprising:

an insulating layer which is provided in contact with a substrate and supports the energy generation element;

at least one heat transmitting layer which is composed of a material having a higher thermal conductivity than that of a material of the insulating layer and which is provided, in the insulating layer, between the energy generation element and the substrate; and a heat transmitting member which thermally connects the at least one heat transmitting layer and the substrate, wherein the heat transmitting member is connected to an area, on the heat transmitting layer, excluding an area directly below the energy generation element in a position interposed between the energy generation element and the substrate.

2. The liquid ejection head according to claim 1, wherein the heat transmitting layer is continuously provided along a direction in which a plurality of the energy generation elements are arranged and the heat transmitting member is connected to an area, on the heat transmitting layer, between areas directly below the plurality of energy generation elements.

3. The liquid ejection head according to claim 1, further comprising a supply port fluidly connected to a pressure chamber in which the liquid caused to be ejected by the energy generation element is stored, the supply port being formed on the substrate, wherein the heat transmitting member is connected to an area, on the heat transmitting layer, between the area directly below the energy generation element and the supply port.

4. The liquid ejection head according to claim 3, wherein the heat transmitting member is connected to an area in which, on the heat transmitting layer, in a planar direction of the heat transmitting layer, a distance from a center of the energy generation element to the heat transmitting member is longer than a half of a distance from the center of the energy generation element to a center of an opening of the supply port.

5. The liquid ejection head according to claim 1, wherein the at least one heat transmitting layer includes a first heat transmitting layer arranged along a surface of the substrate and a second heat transmitting layer arranged, in an area between the first heat transmitting layer and the energy generation element, along the surface of the first heat transmitting layer; and wherein a plurality of the heat transmitting members are connected to an area, on the first heat transmitting layer, excluding the area directly below the energy generation element.

6. The liquid ejection head according to claim 5, further comprising an interposing member which thermally connects an area, on the second heat transmitting layer, directly below the energy generation element and the first heat transmitting layer.

7. The liquid ejection head according to claim 1, wherein the heat transmitting member is in a solid or hollow columnar structure having a plurality of columns.

8. The liquid ejection head according to claim 1, wherein a circuit for supplying the energy generation element with power is provided such that the circuit is incorporated into an area, on a surface of the substrate, opposing the energy generation element or provided so as to contact a lower face of the substrate.

9. A liquid ejection head comprising:

a substrate;

a heat transmitting layer provided above and along a surface of the substrate;

an energy generation element which is provided above the heat transmitting layer and generates energy to be used for ejecting a liquid; and a heat transmitting member which thermally connects the heat transmitting layer and the substrate, wherein as viewed from a direction perpendicular to the surface of the substrate, the heat transmitting layer is provided in a position where the heat transmitting layer at least partially overlaps the energy generation element and the heat transmitting member is provided in a position where the heat transmitting member does not overlap the energy generation element.

10. The liquid ejection head according to claim 9, wherein the heat transmitting layer is provided in an insulating layer having a lower thermal conductivity than that of the heat transmitting layer.

11. The liquid ejection head according to claim 9, wherein the heat transmitting member is in a columnar structure having a plurality of columns extending in a direction crossing the surface of the substrate.

12. A liquid ejection head for ejecting a liquid, comprising;

a substrate;

a heat transmitting layer provided above and along a surface of the substrate;

an energy generation element which is provided above the heat transmitting layer and generates energy to be used for ejecting a liquid; and a heat transmitting member which thermally connects the heat transmitting layer and the substrate, wherein as viewed from a direction perpendicular to the surface of the substrate, with respect to a first area which overlaps the energy generation element and a second area adjacent to the first area, the second area not overlapping the energy generation element, a density of the heat transmitting member provided in the first area is lower than that of the heat transmitting member provided in the second area.

13. The liquid ejection head according to claim 12, wherein the heat transmitting layer is provided continuously in the first area and the second area.

14. The liquid ejection head according to claim 12, wherein the heat transmitting member is not provided in the first area.

15. A liquid ejection apparatus including a liquid ejection head characterized in that the liquid ejection head is used to eject a liquid on a print medium to perform printing, the liquid ejection head comprising:

an insulating layer which is provided in contact with a substrate and supports an energy generation element;

at least one heat transmitting layer which is composed of a material having a higher thermal conductivity than that of a material of the insulating layer and is provided, in the insulating layer, between the energy generation element and the substrate; and a heat transmitting member which thermally connects the at least one heat transmitting layer and the substrate, wherein the heat transmitting member is connected to an area, on the heat transmitting layer, excluding an area directly below the energy generation element in a position interposed between the energy generation element and the substrate.

* * * * *